US007010819B2

(12) United States Patent
Lee

(10) Patent No.: US 7,010,819 B2
(45) Date of Patent: Mar. 14, 2006

(54) UNIVERSAL HAMMOCK SUPPORT

(76) Inventor: Benjamin Michael Lee, 4503 - 18th St., Lubbock, TX (US) 79416

( * ) Notice: Subject to any disclaimer, the term of this patent is extended or adjusted under 35 U.S.C. 154(b) by 0 days.

(21) Appl. No.: 10/701,102

(22) Filed: Nov. 4, 2003

(65) Prior Publication Data

US 2004/0098802 A1 May 27, 2004

Related U.S. Application Data

(60) Provisional application No. 60/428,553, filed on Nov. 21, 2002.

(51) Int. Cl.
*A45F 3/24* (2006.01)
*A45F 3/22* (2006.01)

(52) U.S. Cl. ..... 5/127; 5/120; D6/387

(58) Field of Classification Search ..... 5/127, 5/128, 120; D6/386, 387
See application file for complete search history.

(56) References Cited

U.S. PATENT DOCUMENTS

| | | | | |
|---|---|---|---|---|
| 144,219 | A | | 11/1873 | Park |
| 280,081 | A | | 6/1883 | Rich |
| 381,025 | A | | 4/1888 | Parmalee |
| 935,445 | A | | 9/1909 | Wolf |
| 2,569,596 | A | | 10/1951 | Anderegg |
| 4,757,563 | A | | 7/1988 | An |
| 4,975,994 | A | | 12/1990 | Barmettler |
| D328,198 | S | * | 7/1992 | Blackman ..... D6/631 |
| 5,153,955 | A | | 10/1992 | Singleton, Jr. et al. |
| 6,276,008 | B1 | | 8/2001 | Chen |
| 6,467,109 | B1 | | 10/2002 | Wu |

OTHER PUBLICATIONS

Benjamin M. Lee, Green Eggs & Hammocks, Catalog, 2003 p. 1, Green Eggs & Hammocks, 4116—34th Street Lubbock, Texas 79410 (p. 1 only included).

Jobek, Jobek, Catalog, 2002, p. 47, Jobek, Froschenseestrasse 45, D-87629, Fuessen, Germany (p. 47 only included).

Jobek, Jobek, Catalog, 2002, p. 36, Jobek, Froschenseestrasse 45, D-87629, Fuessen, Germany (p. 36 only included).

Hangouts, Hangouts Handwoven Comfort, Catalog, 2002, p. 1, Hangouts, 1328 Pearl Street Mall, Boulder, CO 80302.

* cited by examiner

*Primary Examiner*—Alexander Grosz

(57) ABSTRACT

According to one embodiment of the invention, a hammock support includes a helically shaped support member having a first end and a second end, the support member adapted to rest on a base and a pair of stability members coupled to the support member and adapted to prevent the support member from rotating around the axis of the support member. The support member is adapted to couple a first hammock to the support member at the first and second ends and a second hammock to the support member adjacent the first and second ends.

3 Claims, 3 Drawing Sheets

UNIVERSAL HAMMOCK SUPPORT

CROSS-REFERENCE TO RELATED APPLICATIONS

This application claims the benefit of Provisional Patent Application:

No.: 60/428,553

FILING DATE: Nov. 21, 2002

NAME OF APPLICANT: Benjamin M. Lee, Lubbock, Texas

TITLE OF INVENTION: Universal Hammock Support

BACKGROUND OF THE INVENTION

1. Technical Field of Invention

The present invention relates generally to the field of hammocks and, more particularly, to a universal hammock support.

2. Discussion of Prior Art

Typically, when a person hears the word "hammock," thoughts of rest and relaxation enter the person's mind. Hammocks are generally thought to be comfortable resting devices suspended between two trees out in the backyard. However, hammocks may also be placed out by a pool or even used indoors.

Although many different designs exist for hammocks, there are generally two types of hammocks. An "American" style hammock typically has a spreader bar near each end of the hammock and is typically hung between support points that are three to four feet above the ground and thirteen to fifteen feet apart. A "traditional" or Mayan style hammock has no spreader bar and is typically hung between support points that are six feet above the ground and twelve feet apart.

Further Discussion of Prior Art—Non Patent Literature Documents (NPLD)—Illustrations P, Q, R, S, T Several hammock support stands are illustrated in the excerpts from a catalogs listed as Non Patent Literature Documents (hereafter NPLD) in accompanying Form PTO/SB/O8B, including Illustrations P, Q, and R. Illustrations P and Q show the American style hammock. Illustration R shows a modified traditional or Mayan style hammock. Illustration S shows a true traditional or Mayan style hammock suspended between two trees, and Illustration T shows a true traditional style hammock suspended from the ceiling or high points on the walls, which illustrates that the traditional style hammock needs comparatively higher attachment ends for proper suspension. The hammock support stands shown in these illustrations are representative of prior art hammock stands.

Illustrations Q and R show hammock support stands that are designed to accommodate the American style hammock, both of which have low attachment ends. Illustration R, showing the modified traditional hammock, is designed to allow the user to extend the attachment end higher to accommodate the modified traditional hammock. But this stand cannot be extended sufficiently to accommodate a true traditional hammock because it is not sufficiently rigid to withstand the typical weight at the requisite height. The higher the ends of this stand are extended, the more likely they are to bend upward and allow the hammock to drop to the ground. Thus the nature of it's manufacture is such that these supports do not extend high enough to accommodate a true traditional hammock, as shown in Illustrations S and T. None of these stands have sufficiently elevated attachment ends to properly support and accommodate a true traditional style hammock at the optimum distance between the hanging points. The inadequacy of prior art hammock support stands is indicated by the fact that when a traditional style hammock is shown in most current advertising literature it is usually attached to a tree, as in illustration S. If a traditional style hammock is shown inside, it is usually attached to the ceiling, or a high point on the wall as in Illustration T.

BACKGROUND—U.S. PATENT DOCUMENTS

U.S. Pat. No. 144,219 to F. Park discloses a portable and substantial frame upon which to swing a hammock. It consists of two bent braces, hinged together at each end, and provided with hooks.

U.S. Pat. No. 280,081 to G. W. Rich discloses a neat-looking portable frame for suspending a hammock. The frame is light and strong, and easily taken apart and put together again for ready use.

U.S. Pat. No. 381,025 to W. F. Parmelee discloses a portable and adjustable frame for supporting a hammock, an awning or tent, a table, a child's cradle, a horizontal bar for gymnastic exercises, or a swing suspended from said bar.

U.S. Pat. No. 935,445 to McClellen D. Wolf discloses an improved hammock support frame which embodies a base having side members and arched elastic bars secure at their central portions on the said side members. Further, the side members and have their ends connected together as an elastic support for the hammock stretched between the ends thereof.

U.S. Pat. No. 2,569,596 to E. W. Anderegg discloses an improved hammock support for selectively suspending a hammock on either a swinging support or on a relatively non-tiltable support.

U.S. Pat. No. 4,757,563 to Young N. An discloses an improved multi-purpose hammock support, comprising main supporting rods connected together by an extension member, and support members connected to the main supporting rods through end connecting members.

U.S. Pat. No. 4,975,994 to Peter Barmettler discloses an improved hammock support which can be dismantled into single elements and stored in a bag, consisting of a keel-like shaped flexible beam formed by telescopically joined elements and stick-like supporting beam legs.

U.S. Pat. No. 5,153,955 to Albert L. Singleton, Jr. et al, discloses a hammock stand, consisting of a curved arch. Total sections are three, joined together with tongue and grooves joints that are reinforced by fasteners and provided with a base to maintain the arch in an upright orientation, thereby creating an attractive, functional hammock stand without a large number of sections.

U.S. Pat. No. 6,276,008 B1 to Fu-Ching Chen discloses a hammock frame which can be dis-assembled into small parts for convenient storage and transportation, comprising two parts; each have a post and two connecting tubes extending radially outward from each post. Each post has two collapsible legs pivotally connected to one of two ends thereof and tubes connected to the other end of each post.

U.S. Pat. No. 6,467,109 B1 to Chung-Sen Wu discloses an improved hammock support assembly which has a foldable support frame, plus a hammock assembly which is easily folded.

As can be seen from the patent and non patent literature, there is a lack of acceptable frame designs to accommodate the traditional style hammock, which requires substantially different hanging criteria from the American style hammock.

Further, no frame design could be found that is designed to accommodate both the traditional style hammock as well as the American hammock in an acceptable manner.

BACKGROUND—OBJECTS AND ADVANTAGES OF THE UNIVERSAL HAMMOCK SUPPORT

Accordingly, my invention provides several objects and advantages over prior art. American style hammocks typically hang well between points that are 3½ to 4½ feet above ground and 13 to 15 feet apart. The traditional hammock typically hangs well between points that are about 6 feet above ground and about 12 feet apart. One advantage of the Universal Hammock Support stand is that the attachment points are sufficiently elevated that a traditional style hammock 200 may be properly and conveniently attached and suspended, as shown in FIG. 2B, 108. Further, the preferred embodiment is designed to permit the proper and convenient attachment of the American style hammock 202 to lower attachment points on the stand, as shown in FIG. 2C, 110.

The Universal Hammock Support is the first stand that effectively accommodates both the Traditional and American style hammocks. This is because the typical hammock stand is designed to support the American style hammock only. That is, if you were to attach a traditional style hammock to a typical hammock stand designed for American styled hammocks, the traditional style hammock would either be stretched too tight, or would be hanging on the ground. Further, the Universal Hammock Support is the first and only spiral or helically shaped stand that completely encircles the user with the frame. Accordingly, the frame above the hammock gives users something to grasp when entering and exiting the hammock. The frame may also be used to support netting or other material to keep out mosquitos, rain, wind, cold or for other purposes, and may be used for other accessories.

SUMMARY OF THE INVENTION

According to one embodiment of the invention, a hammock support includes a helically shaped support member having a first end and a second end, the support member adapted to rest on a base and a pair of stability members coupled to the support member and adapted to prevent the support member from rotating around the axis of the support member. The support member is adapted to couple a first hammock to the support member at the first and second ends and a second hammock to the support member adjacent the first and second ends.

Embodiments of the invention provide a number of technical advantages. Embodiments of the invention may include all, some or none of these advantages. A hammock support according to an embodiment of the present invention is a Universal Hammock Support that is able to suspend both traditional and American style hammocks on the same frame. The Universal Hammock Support is a freestanding frame, which increases which increases the options for locating the hammock. In addition, the hammock support completely encircles the user by having a main support member in the shape of a spiral. This design facilitates entering and exiting the hammock. This design also facilitates easy adaptability to accessories, such as sun covers or bug nets.

Other technical advantages are readily apparent to one skilled in the art from the following figures, descriptions, and claims.

DRAWINGS—BRIEF DESCRIPTION OF FIGURES

For a more complete understanding of the invention, and for further features and advantages, reference is now made to the following description, taken in conjunction with the accompanying drawings, in which.

DRAWINGS—LIST OF REFERENCE NUMERALS

Figure 1:
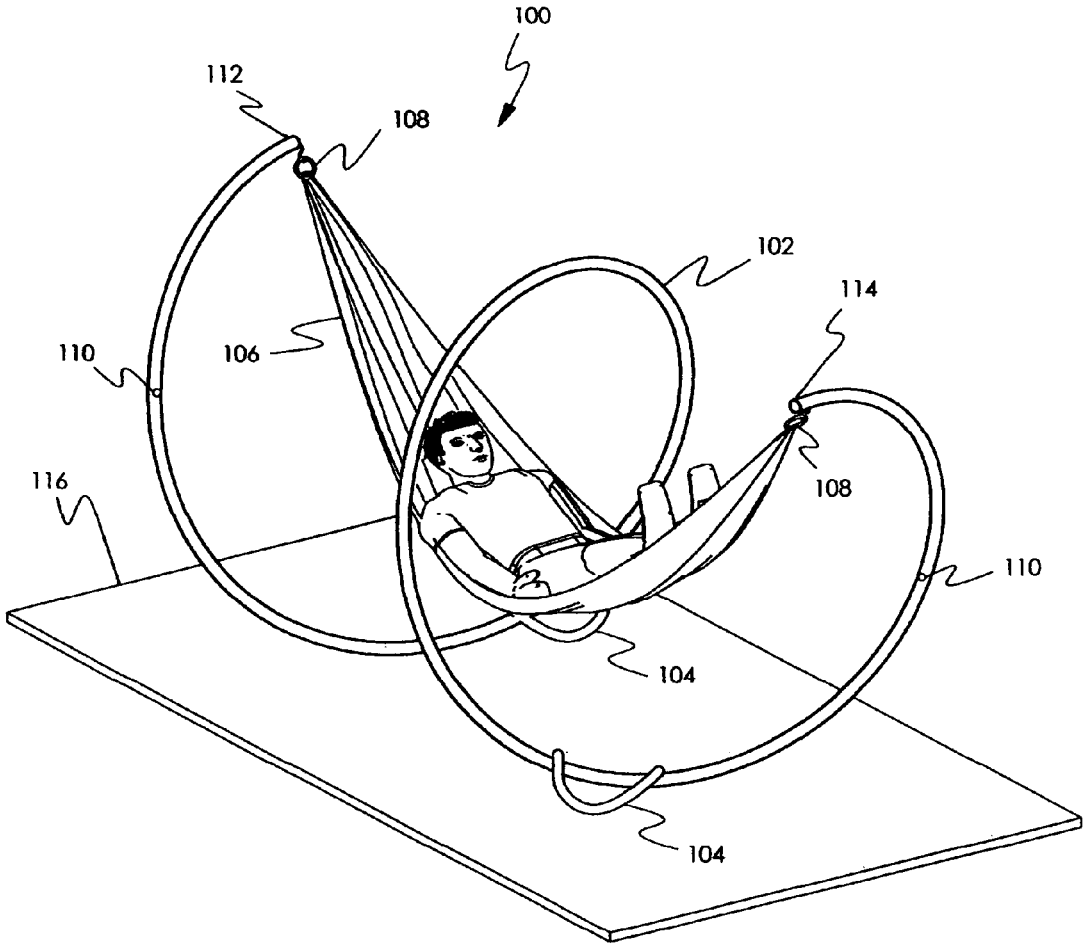
FIG. 1 is perspective view of a Universal Hammock Support in accordance with one embodiment of the present invention.

100 perspective view of Universal Hammock Support
102 support member
104 stability members
108 attachment members
110 second pair of attachment members
112 first end of support member
114 second end of support member
116 base horizontal with the ground

DETAILED DESCRIPTION OF EXAMPLE EMBODIMENTS OF THE INVENTION

Figure 2A:
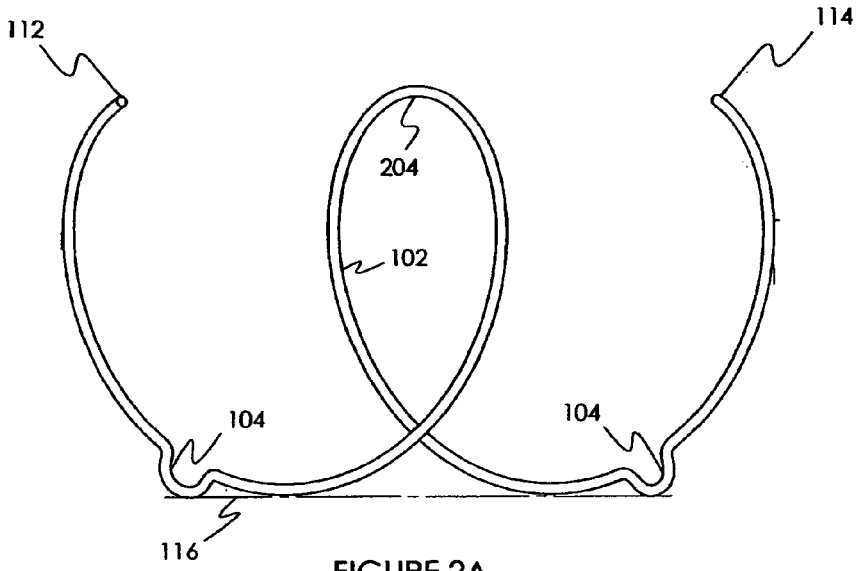
FIG. 2A is an elevation view of the Universal Hammock Support of FIG. 1 in accordance with one embodiment of the present invention.
Figure 2B:
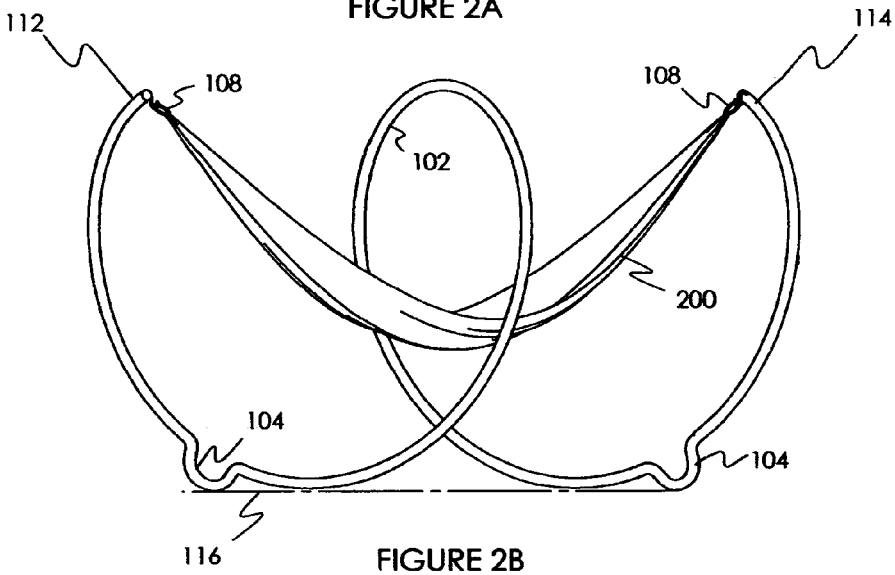
FIG. 2B is an elevation view of the Universal Hammock Support of FIG. 2A illustrating a traditional style hammock being suspended therefrom.
Figure 2C:
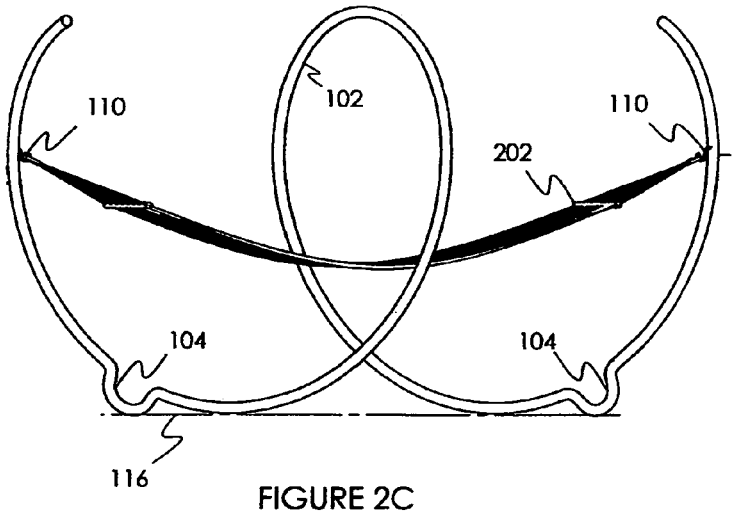
FIG. 2C is an elevation view of the Universal Hammock Support of FIG. 2A illustrating an American style hammock being suspended therefrom.
Figure 3A:
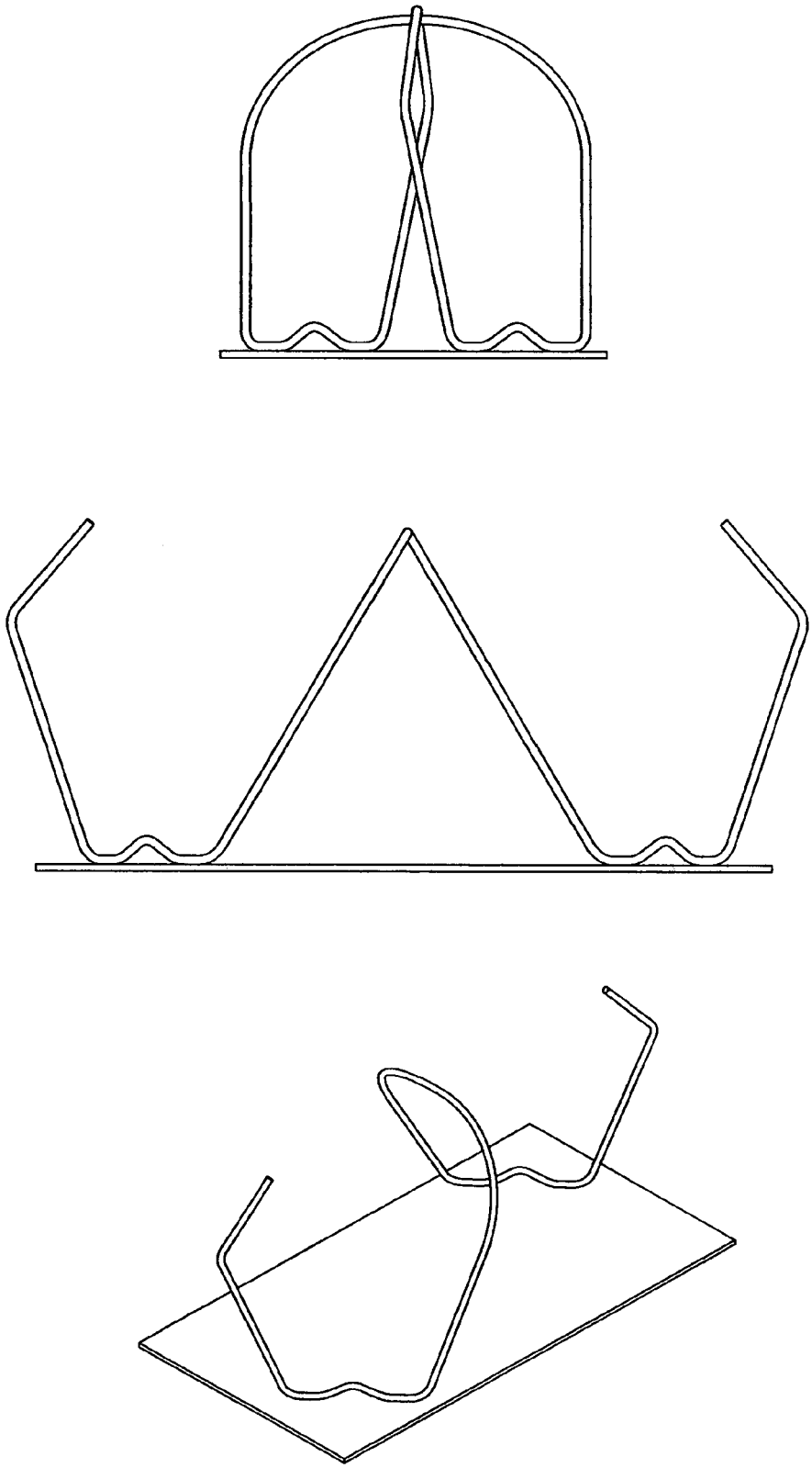

Example embodiments of the present invention and their advantages are best understood by referring now to FIGS. 1–2C of the drawings, in which like numerals refer to like parts.

Description—Preferred Embodiment—FIGS. 1, 2A, 2B, 2C

FIG. 1 is a perspective view of a model of a Universal Hammock Support 100 in accordance with one embodiment of the present invention. As described in further detail below, what makes hammock support 100 "universal" is that it is designed to suspend both traditional style hammocks and American style hammocks using the same frame. In the illustrated embodiment, hammock support 100 includes a support member 102, a pair of stability members 104, a first pair of attachment members 108, and a second pair of attachment members 110.

Support member 102 is illustrated in FIG. 1 as being shaped in the form of a helix; however, support member 102 may take on the form of any suitable type of three-dimensional spiral, helix, coil, partially wave-like, partially straight, or other form that encircles a user. Support member 102 has approximately two turns from a first end 112 to a second end 114; however, support member 102 may have any suitable number of turns from first end 112 to second end 114. Support member 102 may be formed from any suitable material, such as metal, wood, plastic, or composite material. However, in one embodiment, support member 102 is formed from metal tubing. The metal tubing may have any suitable diameter depending upon the desired strength for hammock support 100. Support member 102 is adapted to rest on a base 116, which may be any suitable base, at two support points. To prevent support member 102 from rotating about its axis, hammock support 100 includes stability members 104. Support members 102 and 104 can be integral, or a combination of support pieces.

Stability members 104 are any suitable members adapted to prevent support member 102 from rotating about its axis. Any suitable number of stability members 104 may be utilized within the teachings of the present invention. In the illustrated embodiment, stability members 104 are curved pieces of metal tubing (having either a concave or convex curvature) that are coupled to support member 102 in any suitable manner. For example, in a particular embodiment, stability members 104 are separate elements from support member 102 and have "swaged" ends that slide into metal tubing used to form support member 102 at the appropriate places. In another particular embodiment, as illustrated more clearly in FIGS. 2A–2C, stability members 104 are formed integral with support member 102. Even though illustrated as curved members, stability members 104 may also be other suitable shapes, such as straight members, that extend from support member 102 horizontally with respect to the ground, as represented by base 116.

First pair of attachment members 108 are coupled to first end 112 and second end 114 of support member 102. Attachment members 108 may be coupled to support member 102 in any suitable manner. In a particular embodiment, attachment members 108 are formed integral with support member 102. Attachment members 108 are adapted to couple a hammock to support member 102. Attachment members 108 may be adapted to couple any suitable hammock to support member 102; however, as described in further detail below in conjunction with FIG. 2B, attachment members 108 may couple a traditional style hammock to support member 102.

Second pair of attachment members 110 are coupled to support member 102 adjacent first end 112 and second end 114, respectively. Second pair of attachment members 110 may be coupled to support members in any suitable manner and are adapted to couple a hammock to support member 102. Second pair of attachment members 110 may couple any suitable hammock to support member 102; however, as described in further detail below in conjunction with FIG. 2C, second pair of attachment members 110 may couple an American style hammock to support member 102.

FIGS. 2A through 2C are elevation views of hammock support 100 in accordance with various embodiments of the present invention. FIG. 2B illustrates hammock support 100 supporting a traditional style hammock 200 and FIG. 2C illustrates hammock support 100 suspending an American style hammock 202.

A traditional style hammock has no spreader bar and is typically hung between support points that are approximately six feet above the ground and twelve feet apart. As illustrated in FIG. 2B, traditional hammock 200 is suspended from first pair of attachment members 108 at first end 112 and second end 114. The distance between first pair of attachment members 108 is approximately 12 feet, which is the typical distance between support points of a traditional style hammock. In addition, the height of first attachment members 108 above base 116 as shown on FIG. 2B to be approximately 6 feet, which is the typical height above the ground for a traditional style hammock. However, the present invention contemplates hammock support 100 being manufactured such that first pair of attachment members 108 are spaced apart any suitable distance and are any suitable height above base 116.

Referring to FIG. 2C, an American style hammock 202 is illustrated as being suspended between second pair of attachment members 110. Second pair of attachment members 110 are illustrated in FIG. 2C as being spaced apart approximately 15 feet, which is the typical distance between support points that an American style hammock is spaced. In addition, second pair of attachment members 110 are located at a height of approximately 4 feet above base 116, which is the typical distance for an American style hammock above the ground. However, the present invention contemplates hammock support 100 being manufactured such that second pair of attachment members 110 are spaced apart any suitable distance and are any suitable height above base 116.

In addition to being "universal," hammock support 100 is also adapted to include various accessories, such as a sun cover, mosquito net, or other suitable accessories typically associated with hammocks. In addition, because of an upright central rib 204 (FIG. 2A), a swivel table that clamps to upright central rib 204 may be suspended therefrom.

FIGS. 2B and 2C illustrate that the various embodiments of the Universal Hammock Support 100 can be used to accommodate a traditional style hammock and an American style hammock.

Description—Conclusion, Ramifications, and Scope

Thus it can be seen that the Universal Hammock Support provides a highly functional piece of indoor and outdoor leisure furniture. It provides for suspension of the traditional style hammock at its requisite height, and it accommodates the American style hammock at its conventional height. Because of its helical shape it provides support members which users may grasp in getting in or out of the hammock, and it provides a frame over which netting or other coverings may be draped for protection against various elements.

Although embodiments of the invention and some of their advantages are described in detail, a person skilled in the art could make various alterations, additions, and omissions without departing from the spirit and scope of the present invention as defined by the appended claims.

Accordingly, the scope of the invention should be determined not by the embodiments illustrated, but by the appended claims and their legal equivalents.

What is claimed is:

1. A hammock support, comprising:

a helically shaped support member having approximately two turns from a first end to a second end, the support member adapted to rest on a base at two support points such that both the first end and the second end are a predetermined distance above the base;

a pair of stability members coupled to the support member and adapted to prevent the support member from rotating around the axis of the support member;

a first pair of attachment members coupled to the first and second ends of the support member, the first pair of attachment members adapted to couple a first hammock to the support member; and a second pair of attachment members coupled to the support member adjacent the first end and second ends, the second pair of attachment members adapted to couple a second hammock to the support member.

2. The hammock support of claim 1, wherein the predetermined distance is approximately six feet.

3. The hammock support of claim 1, wherein the second pair of attachment members are coupled to the support member in such a manner that the second pair of attachment members are approximately four feet above the base when the support member is resting on the base.

* * * * *